US006645008B2

(12) United States Patent
Massey et al.

(10) Patent No.: US 6,645,008 B2
(45) Date of Patent: Nov. 11, 2003

(54) CONNECTOR DEVICE FOR GARMENT PATCH ANTENNA

(75) Inventors: Peter J. Massey, Horley (GB); Jonathan Farringdon, Pittsburgh, PA (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 4 days.

(21) Appl. No.: 10/042,446

(22) Filed: Jan. 8, 2002

(65) Prior Publication Data

US 2002/0089399 A1 Jul. 11, 2002

(30) Foreign Application Priority Data

Jan. 11, 2001 (GB) ..... 0100774

(51) Int. Cl.[7] ..... H01Q 1/38
(52) U.S. Cl. ..... 439/581; 343/718
(58) Field of Search ..... 439/63, 581; 333/246; 343/700 MS, 718

(56) References Cited

U.S. PATENT DOCUMENTS 2,881,404 A * 4/1959 Kamm
3,474,385 A * 10/1969 Cefarelli et al.
4,445,742 A * 5/1984 Fullam
5,356,298 A * 10/1994 Voss et al.
5,374,196 A * 12/1994 Horine
5,416,622 A * 5/1995 Engfer
5,810,620 A * 9/1998 Kobayashi et al. ..... 439/610
6,123,550 A * 9/2000 Burkert et al. ..... 439/63
6,433,743 B1 * 8/2002 Massey et al. ..... 343/718

FOREIGN PATENT DOCUMENTS

GB 2345208 * 6/2000
WO WO 00/30206 * 5/2000

* cited by examiner

*Primary Examiner*—Neil Abrams

(57) ABSTRACT

A connector device is provided in the form of a main body component having a lower surface covered with a conductive layer to provide a ground plane and an upper surface carrying a conductive strip portion to form a microstrip line. The combination of the first conductive surface region (ground plane) and second conductive surface region (microstrip line) separated by the main body component dielectric forms a microstrip section. The conductive layer and strip portion are each connected to a conductor of co-axial feed cable. The device is inserted between conductive layers of an antenna of laminar construction, such a as planar inverted F antenna to establish electrical connection between conductors of the feed cable and conduction layers of the antenna. The connector is secured to the antenna by sewing or adhesive. The antenna is normally positioned in a garment.

12 Claims, 5 Drawing Sheets

CONNECTOR DEVICE FOR GARMENT PATCH ANTENNA

TECHNICAL FIELD

The present invention relates to a connector device for providing electrical connection between electrical conductors of a cable and electrically conductive spaced layers of a component, in particular, but not exclusively, where the component is a patch antenna.

BACKGROUND AND SUMMARY

Traditionally, mobile telecommunications equipment including mobile telephones and radio receivers have been provided with their own antenna to form a self contained functional device. More recently, work in the field of wearable electronics has included attempts to combine and integrate electronic equipment, including telecommunications equipment with items of clothing. Such integration can be beneficial in a number of ways including improved ease of carrying electronic equipment, improved functionality and elimination of duplicated components. An example where the last two benefits are realised would be the automatic routing and switching of audio from audio reproduction equipment and a mobile telephone through the save pair of earphones.

In some instances the ability to distribute and integrate equipment in clothing allows for new types of component to be employed which can result in improved performance. An example new component is an antenna of laminar construction such as the one described in British patent application number 9927842.6 (applicants reference PHB 34417) filed on Nov. 26, 1999 in the name of Koninklijke Philips Electronics N.V. and published as WO-A-01/39326 on May 31, 2001 and entitled 'Improved Fabric Antenna'. The antenna is primarily intended for use in mobile telecommunications applications and comprises first and second spaced layers of electrically conducting fabric, a layer of electrically insulating fabric between the first and second layers, first connection means by which electrical contact is made between the first and second layers, and second connection means by which the first and second layers are connectable to telecommunications equipment. The arrangement constitutes a so-called 'planar inverted F antenna (PIFA)'.

The antenna is primarily intended for incorporation into a shoulder portion of a garment in the form of a shoulder pad or into a lapel of a garment, although other locations may be considered. In general it is preferable that fabric is used for construction of the antenna rather than other materials as this offers improved comfort to the wearer through being breathable and in terms of flexibility. The antenna is connectable to telecommunications equipment using a co-axial cable but providing connection between the cable and first and second spaced layers of electrically conducting fabric presents certain problems. Where electrical connection is provided by soldering conductors of the co-axial cable to the electrically conductive fabric the process is time consuming through being labour intensive and the presence of heat means that the soldering process needs to be performed with extreme care in order to avoid heat induced damage to the antenna. This is applicable where the layers of electrically conductive fabric are based on material particularly sensitive to heat, such as nylon. Another problem is that factories and workers in the garment construction industry are generally familiar with garment construction techniques but not processes more commonplace in the electronics industry, in this case the process of soldering. Lack of familiarity and absence of suitably equipped factories has the potential to bring about low output, substantial training costs and high product reject rates. For certain designs of antenna, the precise location chosen to connect the conductors of the co-axial cable to the layers of electrically conductive fabric has a significant influence on the operational characteristics and therefore performance of the antenna so accurate soldering is required for each antenna sample produced. Finally, the resulting connection made between antenna and cable conductor by soldering lacks the required mechanical strength normally required in the field of wearable electronics.

It is therefore an object of the present invention to provide a device for providing electrical connection between electrical conductors of a cable and electrically conductive spaced layers of a component, which device seeks to overcome at least some of the above mentioned problems.

In accordance with the present invention there is provided an electrical connector device for providing electrical connection between electrical conductors of a cable and portions of first and second electrically conductive spaced layers of a patch antenna having a layer of electrically insulating material between the said first and second layers, said connector device comprising:

a main body component having at least two electrically conductive surface regions, each region being in electrical connection with a cable conductor connection means suitable for establishing electrical connection with an electrical conductor of a cable, wherein said main body component is configured for being interposed at least in part between the first and second electrically conductive spaced layers of a patch antenna with each electrically conductive surface region of the main body component providing electrical coupling with a portion of a said one of the first and second electrically conductive spaced layers.

Such electrical coupling may be provided by establishing physical and electrical contact between electrically conductive surface regions of the main body component and electrically conductive spaced layers of the antenna. However, such electrical coupling may be provided in other ways, for example by capacitive coupling between the electrically conductive surface regions of the main body component and the electrically conductive spaced layers of the antenna. If this is the case there may under certain circumstances an insulator between the electrically conductive surface regions of the main body component and the electrically conductive spaced layers of the antenna.

Preferably, the main body component includes an upper surface and a lower surface each bearing at least one of the two electrically conductive surface regions such that when the main body component is interposed between first and second electrically conductive spaced layers of a patch antenna the electrically conductive surface region of the lower surface is electrically coupled with one of the first and second electrically conductive layers and the electrically conductive surface region of the upper surface is electrically coupled with the other one of the first and second electrically conductive layers. Optionally, one of the upper and lower surface is generally wholly covered by one of the electrically conductive surface regions to form a ground plane and the other one of the upper and lower surface is partially covered by another one of the electrically conductive surface regions arranged in a line to form a microstrip line.

The said main body component may be penetrable by a sewing needle in which case the main body component may be inserted between first and second electrically conductive spaced layers of a patch antenna and held in place by subsequently sewing straight through each of the first layer, body component and second layer to hold the items together by thread. Sewing is one of the most widespread techniques in the garment construction industry so the possibility of attaching the body component to the conductive spaced layers in this way is advantageous.

These and other aspects of the present invention appear in the appended claims which are incorporated herein by reference and to which the reader is now referred.

BRIEF DESCRIPTION OF THE DRAWING FIGURES

The present invention will now be described with reference to the Figures of the accompanying drawings in which.

Figure 5A:
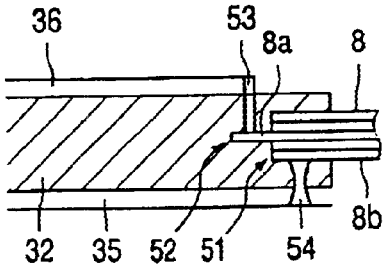
Figure 5B:
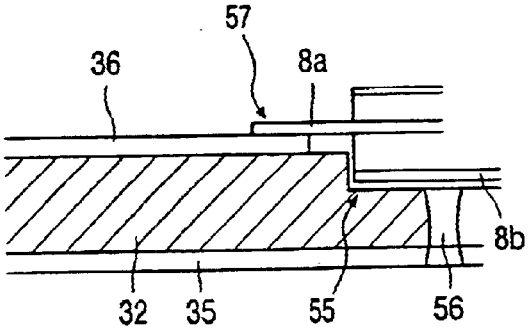
Figure 6:
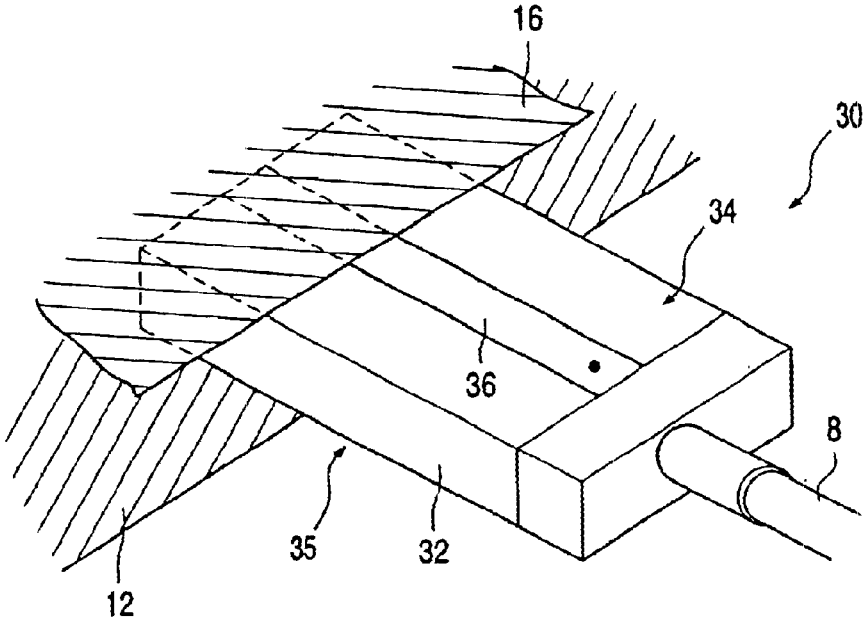
Figure 7:
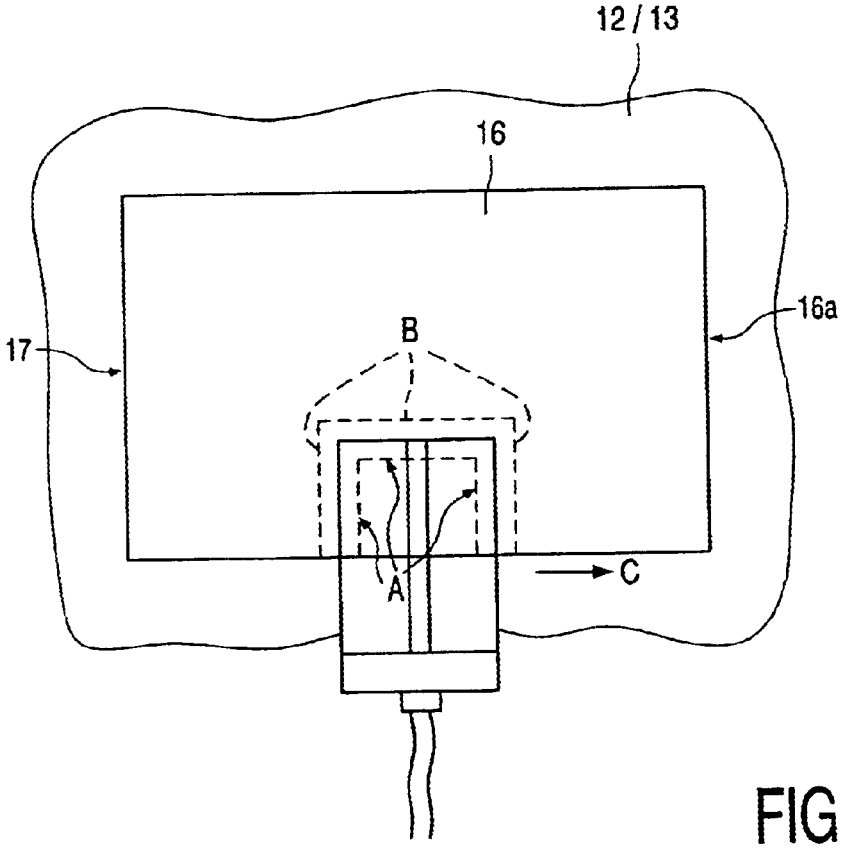
Figure 8:
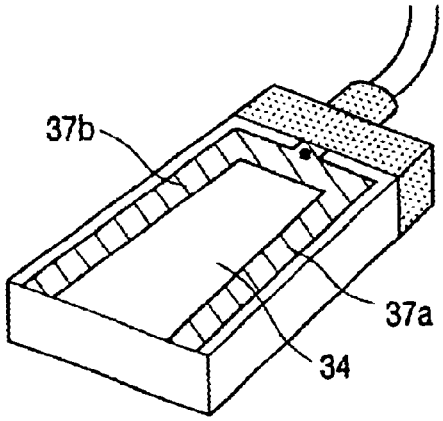

FIGS. 5*a* and 5*b* show in cross section two techniques for attaching cable conductors to the device;

FIG. 6 shows the first embodiment of the device with a patch antenna;

FIG. 7 shows one technique for attaching the first embodiment connector to a patch antenna;

FIG. 8 is a perspective view of a second embodiment of a connector device made in accordance with the present invention; and FIGS. 9*a* to 9*f* show variations of the connector device made in accordance with the present invention.

Figure 10:
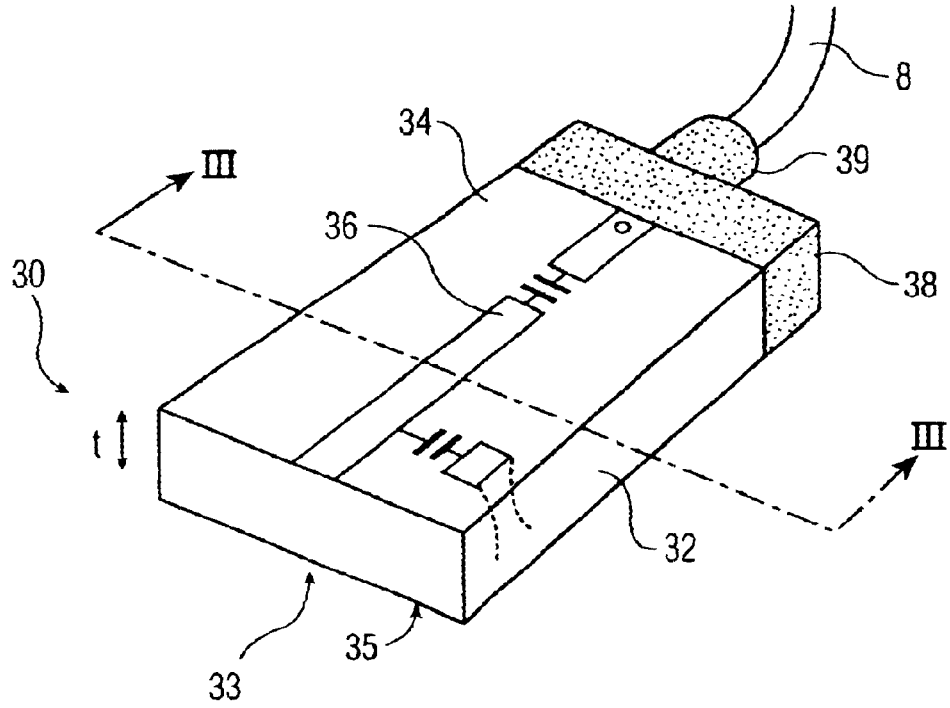

FIG. 10 shows both series and parallel capacitors added to the connector device to suppress unwanted inductance.

It should be noted that the drawings are diagrammatic and not drawn to scale. Relative dimensions and proportions of parts of the Figures have been shown exaggerated or reduced in size for the sake of clarity and convenience in the drawings. The same reference signs are generally used to refer to corresponding or similar features in the different embodiments.

DETAILED DESCRIPTION

Figure 1:
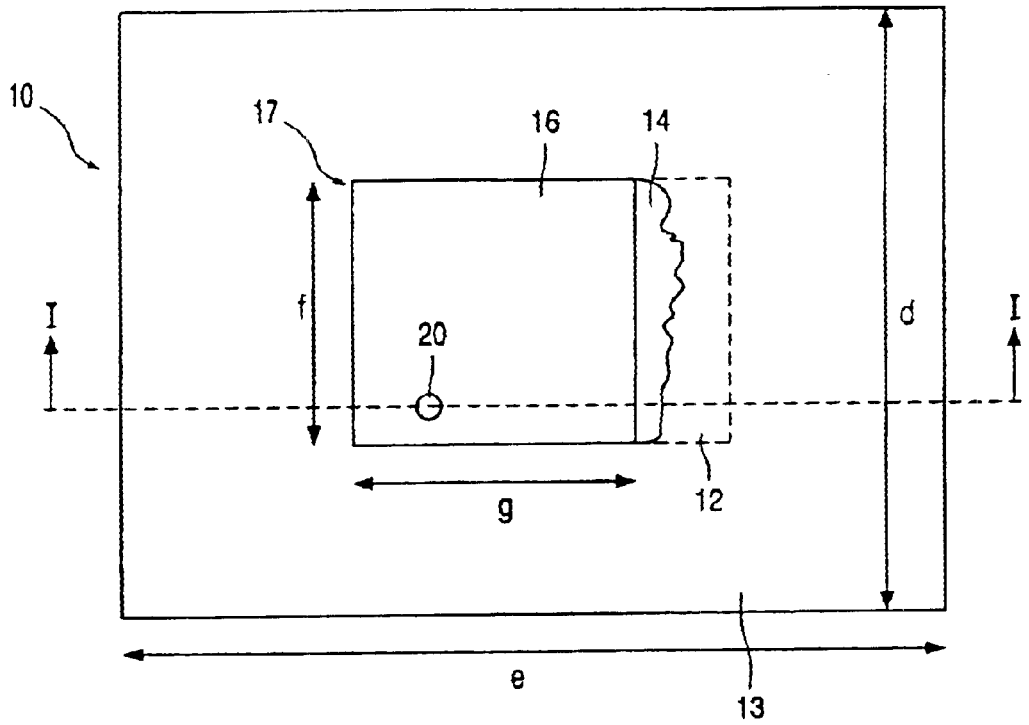
FIG. 1 PRIOR ART
FIG. 1 is a plan view of a patch antenna.
Figure 2:
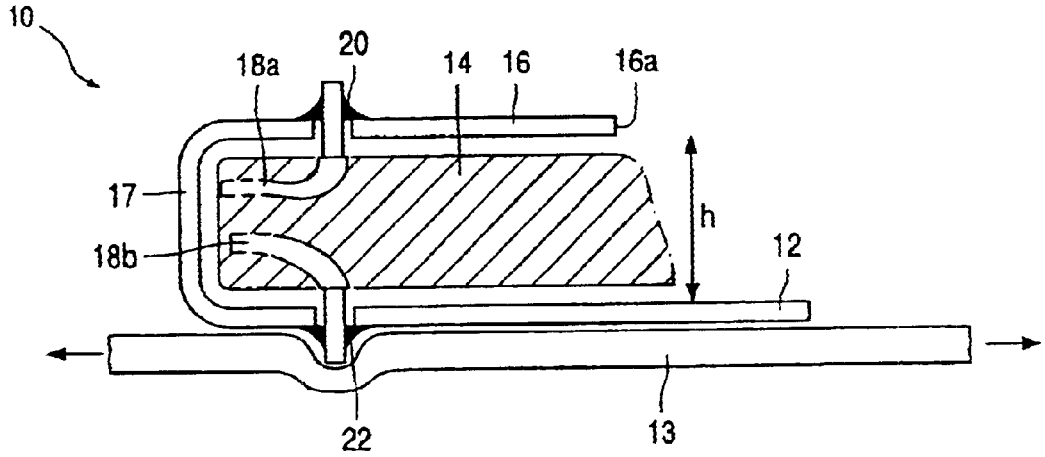
FIG. 2 PRIOR ART
FIG. 2 is a cross sectional view of the patch antenna shown in FIG. 1 taken along line I—I and illustrating a known cable connection technique.

Referring to FIGS. 1 and 2, a patch antenna 10, in this case a planar inverted F antenna (PIFA) comprises a lower layer 12 of conducting fabric, on top of which is mounted one or more layer of insulating material 14, and positioned on the insulating material 14 is an upper layer 16 of conducting fabric which is approximately rectangular in shape and generally smaller in area than the lower layer 12. The upper and lower layers are connected by a neck portion 17 of conducting fabric. The upper layer 16 and neck portion 17 form an inverted 'L' section which faces a ground plane, in this case provided by the lower layer 12 of conducting fabric. In essence the PIFA is a low profile resonant element which is about quarter of a wavelength long, in this case shown by dimension 'g'. Hence an antenna of this type is also known as a quarter wavelength patch antenna. The lower layer 12 is in electrical and physical contact with a base layer 13 which is also made of conducting fabric and is of large area in comparison with the upper layer 16. Lower layer 12 and base layer 13 are shown as two components as may arise in practice due to fabric construction techniques. However it is mentioned for the avoidance of doubt that this is not mandatory and from a functional perspective the lower layer 12 and base layer 13 may be considered as one component. An important requirement is that whatever the form of the ground plane layer, whether provided solely as lower layer 12 or a combination of lower layer 12 and base layer 13, the ground plane has a larger area than the upper layer 16. The component used in the antenna construction may be held together by thread, glue or other suitable methods.

The antenna 10 will normally be positioned in a garment such that the lower layer 12 (or combined lower layer 12 and base layer 13 where provided) are adjacent the wearer in comparison with the upper layer 16. The lower layer 12 (or combined lower layer 12 and base layer 13 where provided) is connected as the ground plane of the antenna 10, and the relative shapes of the layers are such that the ground plane extends substantially beyond the radiating edge 16*a* of the upper layer 16, so as to isolate the wearer from the strongest electromagnetic fields radiated from the antenna. When the antenna is being worn, the amount of signal absorbed by the wearer is reduced.

It will be understood that the antenna 10 can be flexed in use to conform to the shape of the garment while the garment is being worn. The ability to flex seeks to minimise any awareness that the wearer may have of the presence of the antenna in the garment and therefore will not give rise to discomfort. The antenna will therefore be comfortable in use, whilst remaining fully operative even while being flexed.

FIGS. 1 and 2 show a known technique for connecting electronic equipment to the antenna using a co-axial cable. A co-axial cable 18 feeds the antenna, with the core conductor 18*a* being connected to the upper layer 16 at location 20 by a solder joint, and the co-axial cable outer conductor 18*b* being connected to the lower layer 12 at location 22 also by a solder joint. If necessary the one or more layer of insulating material 14 is cut away to allow cable 18 and conductors 18*a*, 18*b* to reach the locations 20 and 22 respectively. The cable 18 is connected to an item such as mobile telecommunications equipment (not shown). As already explained the use of solder joints for making such connections is not ideal.

One example PIFA antenna 10 is 240 millimeters along its dimension d, and 130 millimeters along dimension e; the upper electrode 16 will have dimensions f of 80 millimeters dimension g of 72 millimeters. The separation h of the lower layer 12 and upper layer 16 is typically 10 millimeters. Such an antenna has a 3 dB bandwidth of over 200 MHz and a centre frequency of 925 MHz; it is therefore suitable for use as the antenna of a Global System for Mobile Communications (GSM) telephone and forms a quarter wavelength patch resonator.

A material suitable for providing the layers of conducting fabric is a woven nylon plated with a layer of copper or silver or nickel; the material known as "Shieldex" (Trade Mark) is suitable. The fabric is electrolessly plated. For the insulating layers, materials typically used in the garment construction industry are suitable, such as acrylic, horse hair, cotton, polyester, wool and tailor's foam. Since the antenna can be of not insignificant area and will be mounted in a garment, it is advantageous that it is breathable and lightweight. Such requirements lead to one favoured insulating material being open cell foam.

As an alternative to using a folded layer of conducting material (that is with the fold forming neck portion 17), the upper and lower layers, 12, 16, may be shaped separately and electrical connection established by sewing them together with electrically conductive thread, or by conductive gluing, or by sewing the conductive layers together using a seam which places them in pressurised contact.

Figure 3:
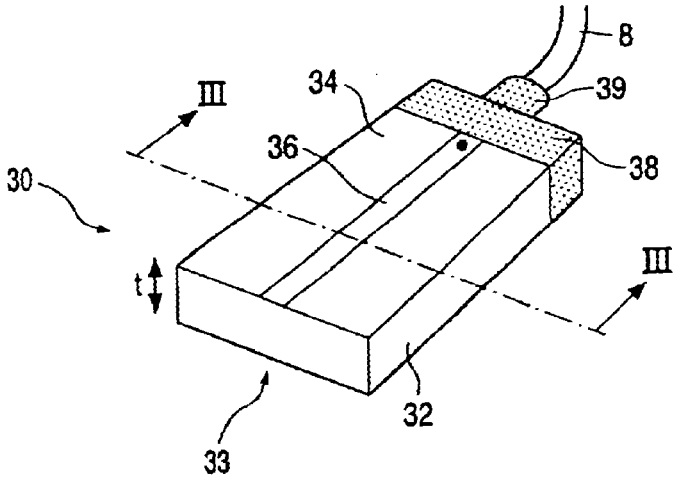
FIG. 3 is a perspective view of a first embodiment of a connector device made in accordance with the present invention.
Figure 4:
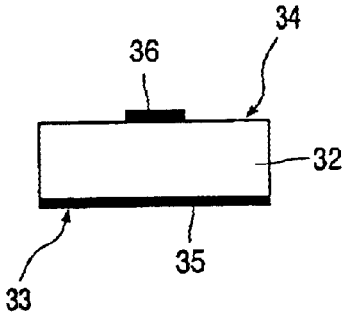
FIG. 4 is a cross sectional view of the first embodiment taken along line III—III of FIG. 3.

Now that the basic construction of a patch antenna has been discussed, the connector device of the invention is shown in FIGS. 3 and 4. The first embodiment 30 of the device comprises a main body component 32 of a dielectric material having a lower surface 33 and an upper surface 34. The lower surface is provided with a first conductive surface region 35 which in this embodiment covers substantially all of the lower surface 33 to form a ground plane. The upper surface 34 is provided with a second conductive surface region 36 formed as a line leading from one end of the main body portion to the other to provide a microstrip line. The combination of the first conductive surface region 35 (ground plane) and second conductive surface region 36 (microstrip line) separated by the main body component 32 dielectric forms a microstrip section.

The main body component 32 may be formed from dielectric materials such as FR4 glass fibre board, air filled PTFE or suitable plastics materials. The first and second conductive surface regions may be of copper, aluminium, gold plated copper or nickel or other appropriate conductive materials, including compounds. The conductive surface regions are formed by any appropriate method including deposition techniques or etching.

The chosen dimensions of the main body component are determined by factors including intended operational frequencies and favoured dimensions may be arrived at through techniques known to the person skilled in the art, such as computer modelling of behaviour.

The connector 30 is also provided with a cable conductor connection means transition section 38 and cable clamp 39. Two examples of the transition section 38 of the cable conductor connection means are shown in FIGS. 5*a* and 5*b* respectively. In each case the co-axial cable is trimmed such that the inner and outer conductors are exposed, but with the inner conductor extending by a greater length. In the arrangement of FIG. 5*a*, two concentric holes are drilled into the dielectric 32 down the centre of the device at one end, with the smaller hole extending more deeply. The prepared cable is inserted into the holes with the central conductor 8*a* extending into the deeper, smaller hole 52 and the outer conductor 8*b* extending into the shallower hole 51. A pin 53 is driven into a further hole made in the dielectric 32 extending from the microstrip line 36 to the inner conductor 8*a* resident in hole 52, to establish electrical contact between the microstrip line 36 and conductor 8*a*. A plated through hole 54 is also provided in the dielectric 32 and extends between the ground plane 35 and outer conductor 8*b* of the coaxial cable. Solder is applied to establish electrical contact between the ground plane 35 and outer conductor 8*b*.

In the arrangement of FIG. 5*b*, a groove 55 is machined into the upper surface of the dielectric 32 in which the exposed outer conductor 8*b* is at least partially accommodated. A plated through hole 56 extends between the groove 55 and ground plane 35 and solder is applied to the outer conductor 8*b* and plated through hole 56 to establish electrical contact between outer conductor 8*b* and ground plane 35. Due to the fact that the groove partially accommodates the cable, the central conductor 8*a* is generally in line with upper microstrip 36 in which case central conductor 8*a* extends a short distance to microstrip section 36 and the conductor 8*a* and microstrip section 36 are soldered together at point denoted by 57.

In both arrangements 5*a*, 5*b* shown, it is desirable to keep the free space length of conductor 8*a* as short as possible to minimise inductance. In both arrangements shown, a cable clamp may be employed to provide mechanical strength.

The exact dimensions of the connection between the coaxial line and the microstrip section are chosen to minimise any electrical mismatch between the coaxial and microstrip sections and favoured dimensions may be obtained by computer simulation. Methods for doing this are well known to those skilled in the art, in particular by microwave engineers.

Turning to FIG. 6 the connector device 30 is shown in situ with at least a part of the main body component 32 inserted between the lower conductive layer 12 and upper conductive layer 16 of a fabric antenna of the type illustrated in FIGS. 1 and 2. Once in position the first conductive surface region 35 of the lower surface of the main body component 32 is in physical and electrical contact with the lower conductive layer 12 (ground plane) of the antenna. At the same time the second conductive surface region 36 (microstrip line) of the upper surface 34 of the main body component is in physical and electrical contact with the upper conductive layer 16 of the antenna. As can be seen the spacing between the fabric patch antenna conducting layers is substantially the same as the dimension t of the device 30 in the vicinity of the device 30. The device is then secured to the antenna with thread by sewing through the upper conductive layer 16, main body component 32 of the device 30 and lower conductive layer 12 (and optionally also base layer 13). While the stitching is omitted from FIG. 6, it is shown in FIG. 7 as the broken lines denoted by 'A', and this stitching serves to pull the conductive layers 12 and 16 against the main body component 32 to establish good electrical contact between the microstrip section ground plane 35 and antenna ground plane 12 and between the microstrip section microstlip line 36 and antenna upper conductive layer 16. Where the main body component 32 is of a material that is impenetrable by stitching (or holes for receiving thread are not provided therein) stitching may instead be provided through the upper and lower conductive layers 12, 16 but arranged around the perimeter of the main body component 32 as denoted by broken lines 'B'. Such stitching serves to pull the conductive layers 12 and 16 towards one another which traps the main body component 32 therebetween and again causes good electrical contact between the microstrip section ground plane 35 and antenna ground plane 12 and between the microstrip section microstrip line 36 and antenna upper conductive layer 16. Where stitching is used the dielectric 32 of the main body component is preferably of sufficiently resilience to maintain most of its thickness.

As an alternative to stitching, it is possible to use suitable glue to glue together the upper and lower conductive layers 12, 16 and/or the main body component 32 to the upper and lower conductive layers 12, 16.

In those cases where the main body component 32 is of a material that is flexible an/or resiliently deformable, the main body component 32 may be provided with a thickness t generally similar to, less than or greater than the separation h between the upper and lower conductive layers 12, 16. However, in those cases where the main body component 32 is of a hard non deformable material it may be preferable to provide the main body component 32 with a thickness t which is less than the separation h between the upper and lower conductive layers 12, 16. Such a combination has the implication that when the device is attached to the antenna by sewing (or other suitable method) the thickness of the antenna in the vicinity of the device 30 will be generally less than the rest of the antenna, i.e. compressed. This may be preferred since when the antenna is incorporated in a garment this reduces the likelihood of a noticeable bulge or hard lump due to the presence of the device 30.

In any case once the device has been fastened to the antenna, the antenna thickness in the vicinity of connecting the device 30 will normally conform in the thickness t of the main body component 32.

It is possible to build the microstrip section to have a characteristic impedance the same as or similar to the characteristic impedance of the coaxial feed cable (typically 50 ohms or 75 ohms). If this is done then the extent to which the device is inserted between the conductive layers of the antenna has minimal effect on the overall electrical performance of the antenna. Such an arrangement may be used to advantage to reduce the precision required in positioning the device with respect to the antenna prior to sewing the device into place which is useful in the environment of the garment construction industry.

With reference to FIG. 7, the device 30 is inserted between the upper and lower conductive layers 12,16 at a side of the antenna therefore providing a feed at the side of the patch. Advantages of this arrangement are ease of manufacture and avoidance of taking the feed cable through the thickest part of the fabric. The location of the connection 20 along the edge of the upper conducting layer 16 (in the direction g) is determined by the impedance of the feed line; it is well known, that for lower impedance feed lines the connection should be nearer the connection between the upper and lower layers 16, 12 while for higher impedance feed lines, the connection should be further away from this connection. During attachment of the device 30 to the antenna where optimal antenna performance is critical it may be possible for test equipment to be used to establish the best attachment position for each antenna sample.

An alternative to directly attaching the device 30 to the upper and lower layers is to provide the antenna itself with micro strip or strip line or twin line or tri-plate section extending away from the upper and lower layers of the fabric antenna and to which the device of the present invention may be connected.

Other variants of device may be employed, as shown for example in FIG. 8 which replaces the single microstrip 36 with dual microstrip sections 37*a*, 37*b* each connected to the central conductor 8*a* of the co-axial cable. Each of the microstrip sections is near to the edge of upper surface which under some circumstances will offer improved connection to the a conductive layer of an antenna in comparison with central microstrip arrangement 36. Rather than dual microstrips 37*a*, 37*b* it is possible to provide only single microstrip 37*a* or 37*b* but arranged near the edge of the surface 34.

Figure 9A:
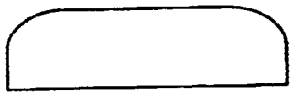
Figure 9B:
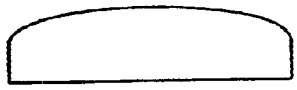
Figure 9C:
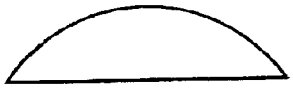
Figure 9D:
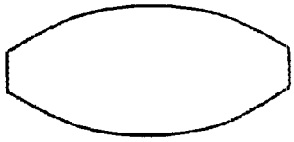
Figure 9E:
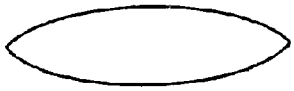
Figure 9F:
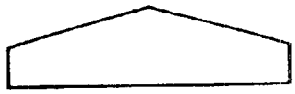

FIGS. 9*a* to 9*f* give a cross sectional view of various alternative shapes of main body component 32. In FIG. 9*a* the corners of the upper surface 34 have been rounded off. In FIGS. 9*b* to 9*d* the upper surface 34 and/or lower surface 32 are curved and in FIG. 9*f* the upper surface has been divided into two planar surfaces. These different shapes may be preferred to the cuboid shape of body component 32 of the first embodiment through offering better contact between the conducting surface regions of the body component 32 with the conductive layers of the antenna and/or through being accommodated more easily by the antenna.

The device described in any of the above paragraphs may be modified to perform an additional matching function by including capacitors and other electronic components. For example for the antenna disclosed in British patent application number 9927842.6 (mentioned earlier), published as WO-A-01/39326, the use of a wide patch to suppress losses due to the Ohmic resistance of the patch results in the patch exhibiting an excess of inductance at the resistance peak corresponding to the quarter wavelength resonance. One method of suppressing this inductance is to cancel it using a capacitor whose reactance is equal in magnitude and opposite in sign to that of the inductance at the resonance. For the present invention, the capacitor may be mounted in series, i.e. across a break in the conductive line 36. Alternatively it may be mounted in parallel, i.e. by connecting one end of the capacitor to the conductive line 36, and the other end to a conductive pad which is connected to a via which in turn connects to the conducting surface 35. These methods of mounting and connecting components are well known in printed circuit board manufacture. Because of their small size and ease of mounting, surface mount devices are the preferred types of components for these applications.

It will be appreciated by those familiar with radio frequency matching filters that the techniques described in the above example can be extended to cover other surface mount components such as inductors. Moreover they can include a multiplicity of such components mounted on conducting tracks on the upper surface of the present invention (i.e. substantially in the same plane as the conductive line 36), and connected by vias to the conducting surface 35, to form a multi-stage matching filter.

To avoid adverse electrical effects, particularly shorting across the components and conducting tracks the matching filters described above should be placed on the part of the present invention that is not inserted beneath the antenna's conducting layer 16. Alternatively the matching filters could be protected from the influence of the conducting layer 16 by placing an insulating layer above the matching filter structure.

While the present invention has been described for use with a patch antenna in the form of a planar inverted F antenna, it is suitable for use with other types of antenna such as a half wave patch antenna. Indeed it is possible that the device of the present invention may be used with components other than antennas providing such components are of laminar construction.

From reading the present disclosure, other modifications will be apparent to persons skilled in the art. Such modifications may involve other features which are already known in the design, manufacture and use of components of laminar construction, including antennas (fabric or otherwise) and applications thereof and which may be used instead of or in addition to features already described herein.

What is claimed is:

1. An electrical connector device for providing electrical connection between electrical conductors of a cable and portions of first and second electrically conductive spaced layers of a patch antenna having a layer of electrically insulating material between the said first and second layers, said connector device comprising:

a main body component of a dielectric material having at least first and second electrically conductive surface regions on opposing sides thereof, each region being in electrical connection with a cable conductor connection means suitable for establishing electrical connection with an electrical conductor of a cable, wherein said main body component is configured for being interposed at least in part between the first and second electrically conductive spaced layers of a patch antenna with said first and second electrically conductive surface regions of the main body component providing electrical coupling with a portion of said first and second electrically conductive spaced layers, respectively.

2. The device of claim 1 wherein the main body component includes an upper surface and a lower surface each bearing at least one of the two electrically conductive surface regions such that when the main body component is interposed between first and second electrically conductive spaced layers of a patch antenna the electrically conductive surface region of the lower surface is electrically coupled with one of the first and second electrically conductive layers and the electrically conductive surface region of the upper surface is electrically coupled with the other one of the first and second electrically conductive layers.

3. The device of claim 2 wherein one of the upper and lower surface is generally wholly covered by one of the electrically conductive surface regions to form a ground plane and the other one of the upper and lower surface is partially covered by another one of the electrically conductive surface regions arranged in a line to form a microstrip line.

4. The device of claim 3 wherein said main body component, ground plane and microstrip line collectively provide a device microchip section.

5. The device of claim 1 wherein said cable conductor connection means includes a transition section having a link extending from one of the at least two electrically conductive surface regions to a conductor of the cable.

6. The device of claim 5 wherein said cable conductor connection means includes a cable clamp.

7. The device of claim 1 wherein said main body component is generally of parallelepiped shape with two major surfaces each bearing one of the two electrically conductive surface regions.

8. The device of claim 1 wherein at least one of the two electrically conductive surface regions is provided on a curved surface of the main body component.

9. The device of claim 1 wherein said main body component is penetrable by a sewing needle.

10. The device of claim 1 where in said main body component is of a resiliently deformable material.

11. The device of claim 1 and further comprising electronic components such as capacitors.

12. A patch antenna including the device of claim 1.

* * * * *